US008069716B2

(12) United States Patent
Panahi

(10) Patent No.: US 8,069,716 B2
(45) Date of Patent: Dec. 6, 2011

(54) MULTI-COUPLING REDUCED LENGTH MEASURE WHILE DRILLING APPARATUS

(75) Inventor: Massoud Panahi, Katy, TX (US)

(73) Assignee: Scientific Drilling International, Inc., Houston, TX (US)

( * ) Notice: Subject to any disclaimer, the term of this patent is extended or adjusted under 35 U.S.C. 154(b) by 0 days.

(21) Appl. No.: 12/946,410

(22) Filed: Nov. 15, 2010

(65) Prior Publication Data

US 2011/0220414 A1 Sep. 15, 2011

Related U.S. Application Data

(63) Continuation-in-part of application No. 11/820,790, filed on Jun. 21, 2007, now abandoned.

(51) Int. Cl.
*E21B 44/00* (2006.01)
*E21B 4/02* (2006.01)
*E21B 7/08* (2006.01)

(52) U.S. Cl. ..... 73/152.46

(58) Field of Classification Search ..... 73/152.03, 73/152.19, 152.46; 340/353.3, 854.6, 856.3, 340/856.8, 870.31; 367/81, 83; 175/40, 175/79, 106, 107
See application file for complete search history.

(56) References Cited

U.S. PATENT DOCUMENTS 2,354,887 A * 8/1944 Silverman et al. ..... 340/854.6
2,852,230 A * 9/1958 Garrison ..... 175/58
3,079,549 A * 2/1963 Martin ..... 324/323
4,181,014 A * 1/1980 Zuvela et al. ..... 340/853.5
4,494,072 A * 1/1985 Jeter et al. ..... 324/347
4,624,309 A * 11/1986 Schnatzmeyer ..... 166/66
4,662,458 A * 5/1987 Ho ..... 175/27
4,766,442 A * 8/1988 Issenmann ..... 343/719
5,058,077 A * 10/1991 Twist ..... 367/25
5,074,681 A * 12/1991 Turner et al. ..... 384/613
5,160,925 A * 11/1992 Dailey et al. ..... 340/853.3
5,212,495 A * 5/1993 Winkel et al. ..... 343/872
5,448,227 A * 9/1995 Orban et al. ..... 340/854.4
5,456,106 A * 10/1995 Harvey et al. ..... 73/152.46
5,467,832 A * 11/1995 Orban et al. ..... 175/45
5,563,512 A * 10/1996 Mumby ..... 324/339
5,661,402 A * 8/1997 Chesnutt et al. ..... 324/338
5,679,894 A * 10/1997 Kruger et al. ..... 73/152.03
5,817,937 A * 10/1998 Beshoory et al. ..... 73/152.46
5,924,499 A * 7/1999 Birchak et al. ..... 175/40
6,092,610 A * 7/2000 Kosmala et al. ..... 175/61
6,100,696 A * 8/2000 Sinclair ..... 324/339
6,427,783 B2 * 8/2002 Krueger et al. ..... 175/40
6,540,032 B1 * 4/2003 Krueger ..... 175/40
6,564,883 B2 * 5/2003 Fredericks et al. ..... 175/50
6,909,666 B2 * 6/2005 Dubinsky et al. ..... 367/81
6,915,686 B2 * 7/2005 Baustad ..... 73/152.46
7,303,007 B2 * 12/2007 Konschuh et al. ..... 166/250.01
2002/0175003 A1 * 11/2002 Pisoni et al. ..... 175/74
2003/0213620 A1 * 11/2003 Krueger ..... 175/40
2008/0211687 A1 * 9/2008 Price et al. ..... 340/854.3
2009/0153355 A1 * 6/2009 Price et al. ..... 340/854.6

* cited by examiner

*Primary Examiner* — John Fitzgerald
(74) *Attorney, Agent, or Firm* — Adolph Locklar

(57) ABSTRACT

A downhole drilling apparatus for measure while drilling including a housing defining a longitudinal housing axis, wherein the housing has an upper end and a lower end. A motor includes a rotor, wherein the rotor is adapted to be driven by drilling fluids. A first drive coupling is coupled between the rotor and a first driven rod. A second drive coupling is coupled between the driven rod an a connecting shaft. A third drive coupling is coupled between the connecting shaft and a second driven rod. A fourth drive coupling is coupled between the second driven rod and a motor bearing section, wherein the connecting shaft extends through an offset bore in the housing and transmits power from the motor to the drill bit.

16 Claims, 7 Drawing Sheets

MULTI-COUPLING REDUCED LENGTH MEASURE WHILE DRILLING APPARATUS

CROSS REFERENCE TO RELATED APPLICATION

This application is a continuation in part of application Ser. No. 11/820,790 filed Jun. 21, 2007, now abandoned, entitled "Reduced Length Measure While Drilling Apparatus Using Electric Field Short Range Data Transmission."

BACKGROUND OF THE INVENTION

This invention relates generally to a measure while drilling apparatus used for directional drilling of boreholes in the earth. Such drilling generally includes a drilling motor, sensors for drill string or hole inclination, direction and various drilling parameters as near to the bit as feasible means for transmitting such sensor data to a location above the drilling motor, and a bent subassembly which provides the means for directional drilling.

In the prior art, drilling motors are known often to be of the "Moineau" or progressive-cavity type, operated by the flow of drilling fluids pumped down through the drill string from the surface. Such motors require coupling mechanism to couple the eccentric motion of the drill-motor rotor to the drill bit. One well-known coupling means is a flexible torsion bar as disclosed in certain prior patents, such as U.S. Pat. Nos. 5,090,497, 5,456,106 and 5,725,062. In the prior art it is also known to use sensing means for inclination, direction and other drilling parameters below the drilling motor. In U.S. Pat. No. 5,456,106 a sensor housing having an axial opening therethrough provides a pathway for the flow of the drilling fluid to the bit region. Since the sensing means are below the drilling motor, some way for short range communication is required to transmit the data to a point above the drilling motor for retransmission to the surface. Wired connections for such short range transmission are shown in U.S. Pat. No. 5,456,106 in which the wires are placed within the outer case of the drilling motor and in U.S. Pat. No. 5,725,062 wherein the wires are placed within the rotor of the drilling motor. U.S. Pat. No. 5,160,925 discloses use of a toroid core with a primary winding on the core, the drill string being located through the center of the opening. Electrical signal applied to the primary winding induce currents in the drill string components, that are detected by a similar toroid core at a higher location in the drill string above the drilling motor. U.S. Pat. No. 6,057,784 discloses a solenoid transmitting core with ferrite elements embedded in the core to enhance the launching of a magnetic field into the drilling assembly. The wind connections disclosed in such patents have not generally been adopted. Other approaches require complicated mechanical structures and a large number of parts and assemblies.

In location of the sensing means below the drilling motor causes an increase in length of the complete assembly. Such sensing means may be a separate subassembly or may be incorporated in the bent subassembly. Incorporation in the bent subassembly may shorten the overall length, but adds to the problem of not having the inclination and direction sensors correctly aligned with the longitudinal axis of the drill string.

In the prior art, a recessed insulated conductive element is used to inject electrical signal currents directly into a formation for detection at another nearby location in the drill string using another insulated conductive element. Experiments have shown that such direct electric injection and detection of currents can provide a very simple and effective short range communication system requiring less mechanical complexity in the drill string structure below a drilling motor. Further, the reduced size of such an apparatus permits the placement of desired sensing means and data transmission means in parallel with the motor torsion bar rather than in series with the torsion bar. This provides a significant reduction in the overall apparatus. Such parallel placement of the sensing means also permits replacement in the field of the entire sensor assembly, without major disassembly of the complete measure while drilling apparatus.

This disclosure provides improved reduced-length measure while drilling apparatus by using an electric field short range data transmission apparatus and with the sensing and data transmission elements placed in parallel with the torsion bar of the drilling motor. The disclosure also provides an apparatus in which the sensing and data transmission elements can be replaced without complete disassembly of the apparatus.

SUMMARY OF THE INVENTION

A downhole drilling apparatus for measure while drilling including a housing defining a longitudinal housing axis, wherein the housing has an upper end and a lower end. A motor includes a rotor, wherein the rotor is adapted to be driven by drilling fluids. A first drive coupling is coupled between the rotor and a first driven rod. A second drive coupling is coupled between the driven rod an a connecting shaft. A third drive coupling is coupled between the connecting shaft and a second driven rod. A fourth drive coupling is coupled between the second driven rod and a motor bearing section, wherein the connecting shaft extends through an offset bore in the housing and transmits an eccentric motion of the motor to the drill bit.

These and other objects and advantages of the invention, as well as the details of an illustrative embodiment, will be more fully understood from the following specification and drawings, in which:

BRIEF DESCRIPTION OF THE FIGURES

FIG. 1 is a longitudinal cross section of the apparatus of the present invention showing major components;

DETAILED DESCRIPTION

Figure 1A:
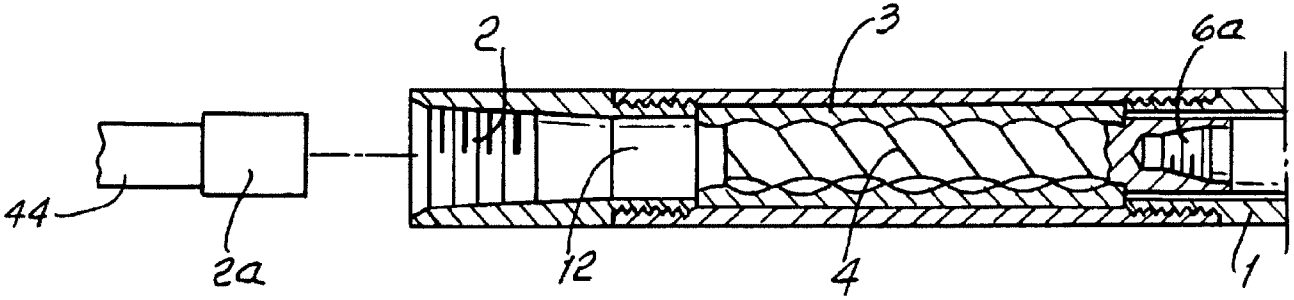
FIGS. 1*a*, 1*b*, and 1*c* illustrate a longitudinal cross-section of the apparatus of the present invention, and wherein, 1*b* is as extension of 1*a*, and 1*c* is an extension of 1*b;*
Figure 1B:
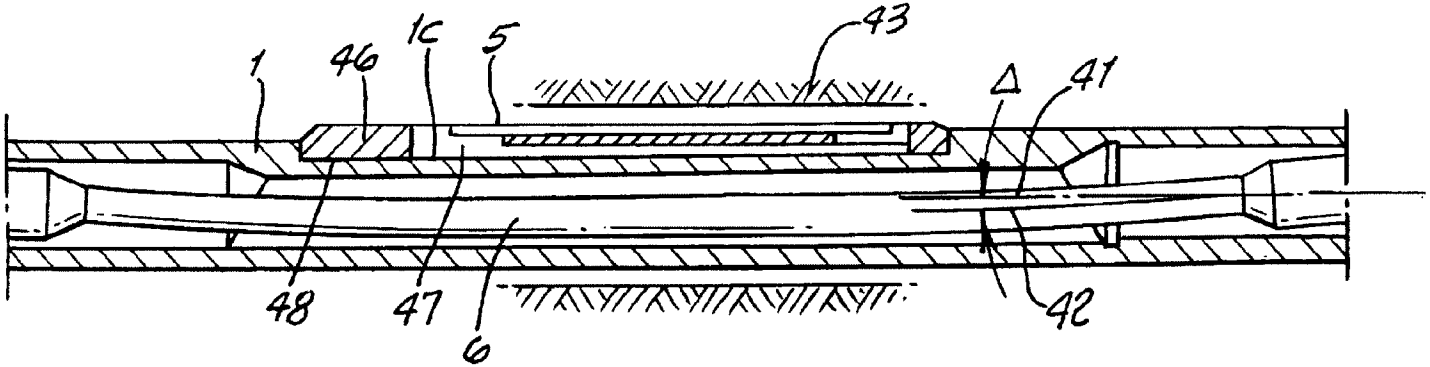
Figure 1C:
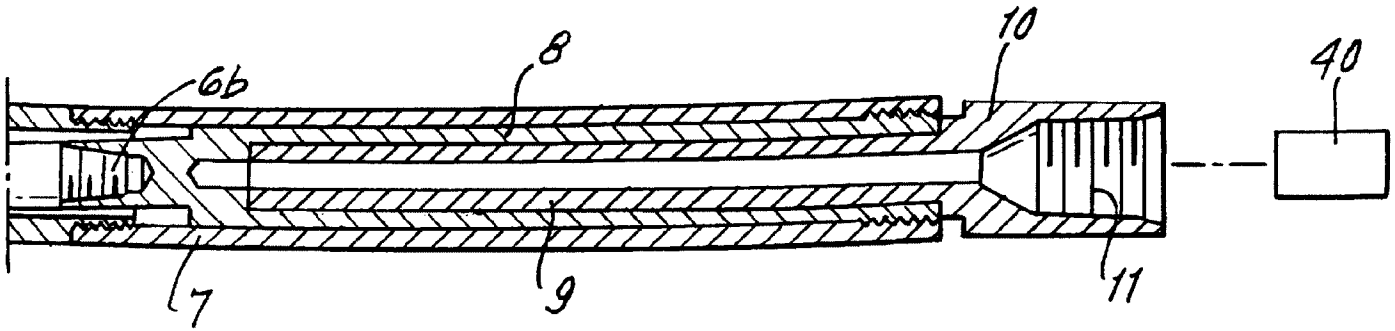

FIG. 1*a* thru 1*c* shows a longitudinal cross section of the apparatus of the present invention, showing major components. The outer case or main housing 1, which may include multiple sections along its length, is shown to have a threaded tubular connection 2 at its upper end, for connection to other elements of a drill string above this apparatus indicated generally at 2*a*. A stator 3 and a rotor 4 for a "Moineau" or progressive-cavity type motor operated by the flow of drilling fluids pumped down through the drill string from the surface, are shown. A torsion bar or flexible shaft 6 is used to connect the eccentric motion of the rotor 4 to the lower elements of the apparatus. See connection 6*a*. The lower end of the shaft 6 is connected as at 6*b* to a rotary shaft 10 which drives a bit attached to the threaded connection 11 at the lower end of the apparatus. The bit diagrammatically indicated at 40. A bent subassembly 7 and 8 houses a radial and thrust bearing assembly 9 that transfers load from the bit at the lower end of the assembly, and shaft 10, to the case 8. Bending of the shaft 6 as shown accommodates both the eccentric motion of the rotor 4 and the bend angle between the axis 41 of the housing 1 and the bent axis 42 of the bent subassembly 7 and 8. As shown, axis 42 is concave toward axis 41, and convex radially away from axis 42. For suitable drilling operations the bend angle Δ between the housing axis 41 and the bent subassembly axis 42 may lie in the range of 0 to 4 degrees.

A sensor and data transmission assembly is provided at 5 adjacent case 1, and contains short range data transmission circuitry of the type shown in U.S. patent application Ser. No. 11/353,364, "Electric Field Communication for Short Range Data Transmission in a Borehole", wherein a recessed insulated conductive element is used to inject electrical signal currents outwardly directly into a formation 43 for detection at another nearby location in the drill string using another insulated conductive elements. The other nearby location is typically in the drill string as at 44 above this apparatus, where desired data may be transmitted on to a surface location by known transmission means. Two well known such means are by pressure pulses induced in the drilling fluid or by electrical transmission. Note particularly the parallel placement of the sensor and data transmission assembly 5 and the torsion bar or flexible shaft 6 such that no length is added to the total apparatus. Also note that the sensor and transmission assembly may be removed and replaced without any disassembly of the total apparatus. For this purpose assembly 5 may be located in a carrier 46 removably received sidewardly at 48 in a cavity 47 defined by housing section 1*c*.

Figure 5:
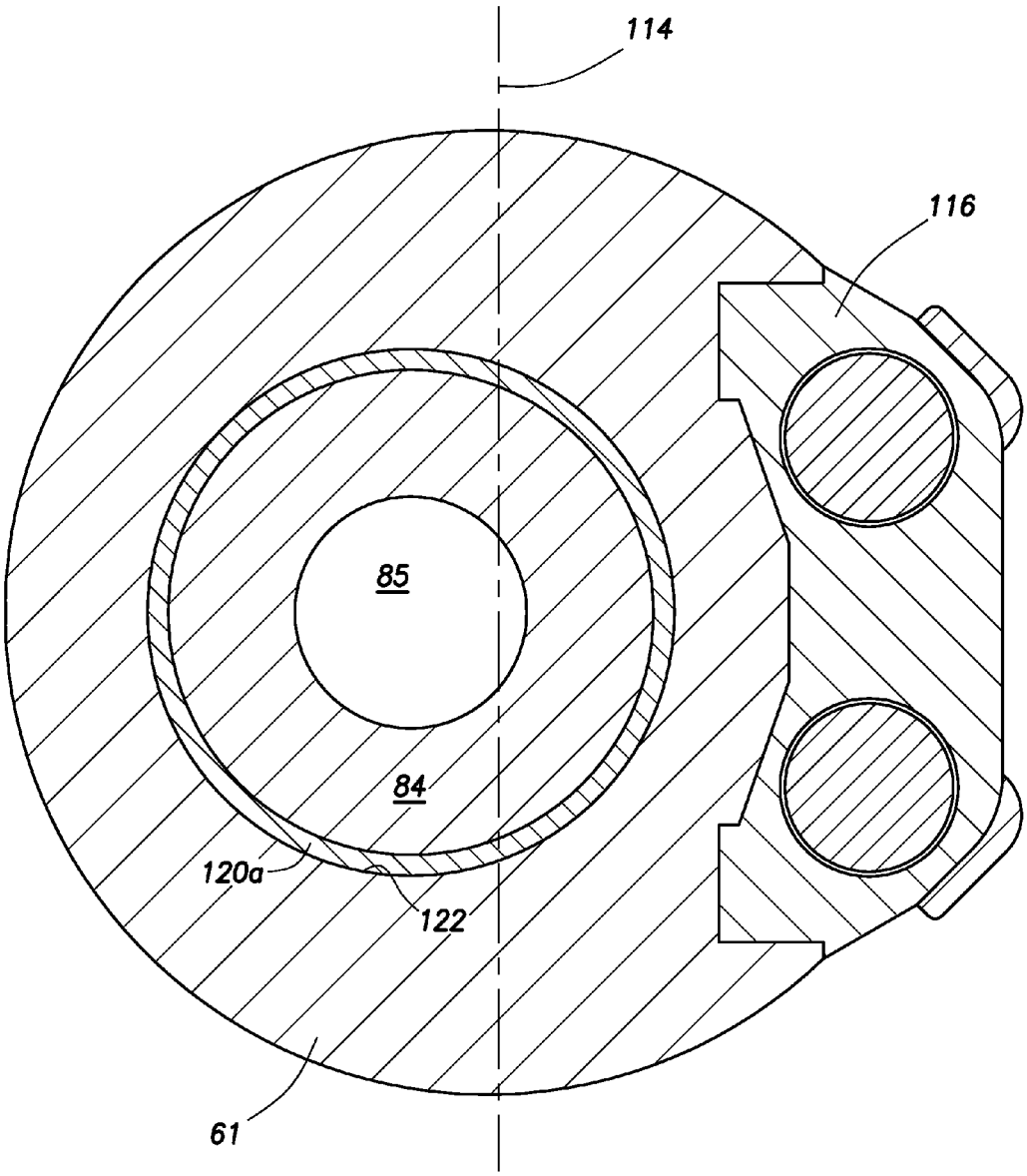
FIG. 5 is a sectional plan view of the apparatus of FIG. 3 taken along section lines 5-5.

Any selected array of sensors may be included in the sensor and data transmission assembly 5. Typically, such an array may include inclination sensors, direction sensors, formation resistivity sensors, gamma ray sensors, pressure sensors. RPM sensors, torque sensors, weight-on-bit sensors and temperature sensors. Requirements on what may be placed in the assembly 5 are fit and power requirements. A block diagram of sensor and data transmission assembly elements including elements of an upper location to communicate therewith, is shown in FIG. 5 of U.S. patent application Ser. No. 11/353,364, "Electric Field Communication for Short Range Data Transmission in a Borehole" incorporated herein by reference.

Drilling fluid enters the apparatus of the invention through the connection 2 and flows through the interior of the apparatus as at 12 and past shaft 6, to exit the apparatus into the drill bit at 40, through connection 11. Since the sensor and data transmission assembly 5 is in parallel with and located at one side of the torsion bar or flexible shaft 6, there is no need for an axial opening through the assembly 5 as is described for the sensor housing in U.S. Pat. No. 5,456,106.

Figure 2A:
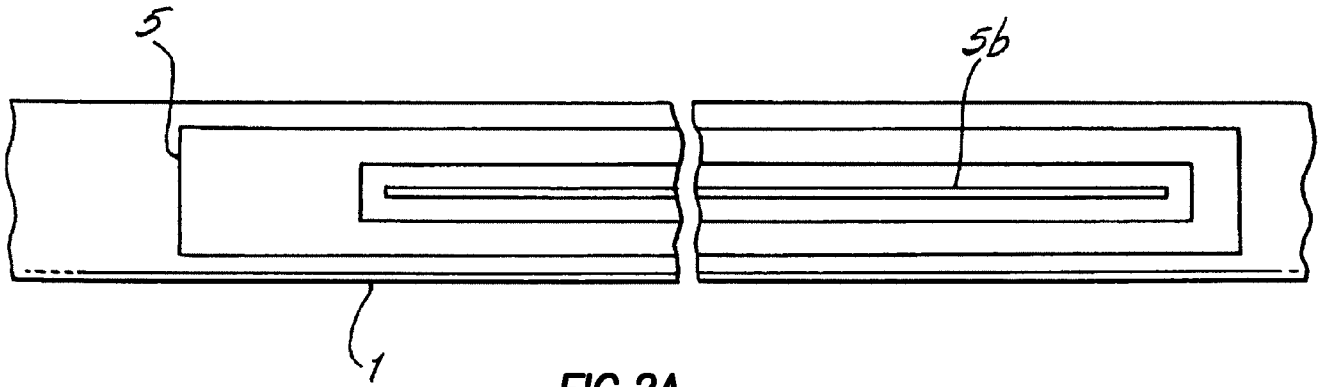
FIG. 2*a* is a cross-sectional view of sensor and data transmission means, showing the recessed insulated conductive element used to inject and/or receive currents into the formation.
Figure 2B:
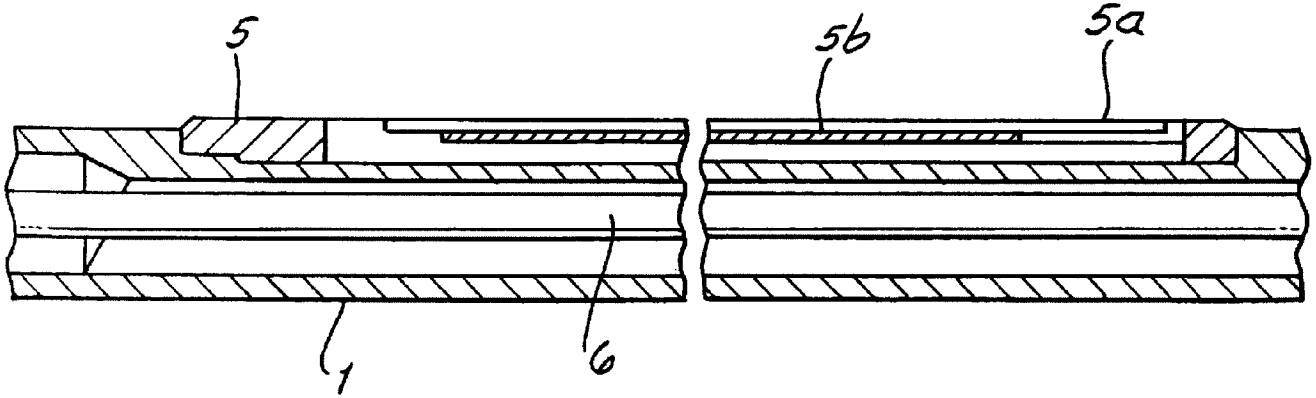
FIG. 2*b* is a longitudinal cross section of the sensor and data transmission means showing the recessed insulated conductive element used to inject and/or receive currents into the formation.

FIG. 2*a* is a view of the sensor and data transmission means 5 showing the recessed insulated conductive element 5*b* and an insulating material 5*a* used to inject and/or receive currents into or from the formation, or to pass electric fields. FIG. 2*b* is a longitudinal cross section of the sensor and data transmission means showing the same conductive element 5*b* and insulating material 5*a*.

FIGS. 3A, 3B, 4, and 4A illustrate an alternative embodiment of the downhole drilling apparatus 60 of the present disclosure. The alternative embodiment includes a housing 61 including a first drive coupling 62 having upper end 64 that is attached to rotor 66 that is similar to rotor 4 shown in FIG. 1*a*. Lower end 68 of first drive coupling 62 is attached to first end 70 of first driven rod 72. Second end 74 of first driven rod 72 is attached to an upper end 76 of second drive coupling 78 and lower end 80 of the second drive coupling 78 is attached to proximate end 82 of connecting shaft 84. Shaft bore 85 extends through connecting shaft 84. Top end 88 of third drive coupling 90 is attached to distal end 86 of connecting shaft 84 and bottom end 92 of third drive coupling 90 is attached to upper portion 94 of second driven rod 96. Lower portion 98 of the second driven rod 96 is attached to upper end 100 of fourth drive coupling 102. Lower portion 104 of fourth drive coupling is attached to motor bearing section 106 and is connected to drill bit 108.

In operation, the connecting shaft 84 transmits rotational motion from the motor and the power generated by the motor through the offset bore to the drill bit. It is contemplated that drive couplings, driven rods, and connecting shaft described herein can be attached by known latching mechanisms such as a combination of pins and set screws. Other methods of attachment will be apparent to those of ordinary skill in the art. Recess 110 is disposed on housing 61 to accommodate sensor and data transmission assembly 111.

Figure 4:
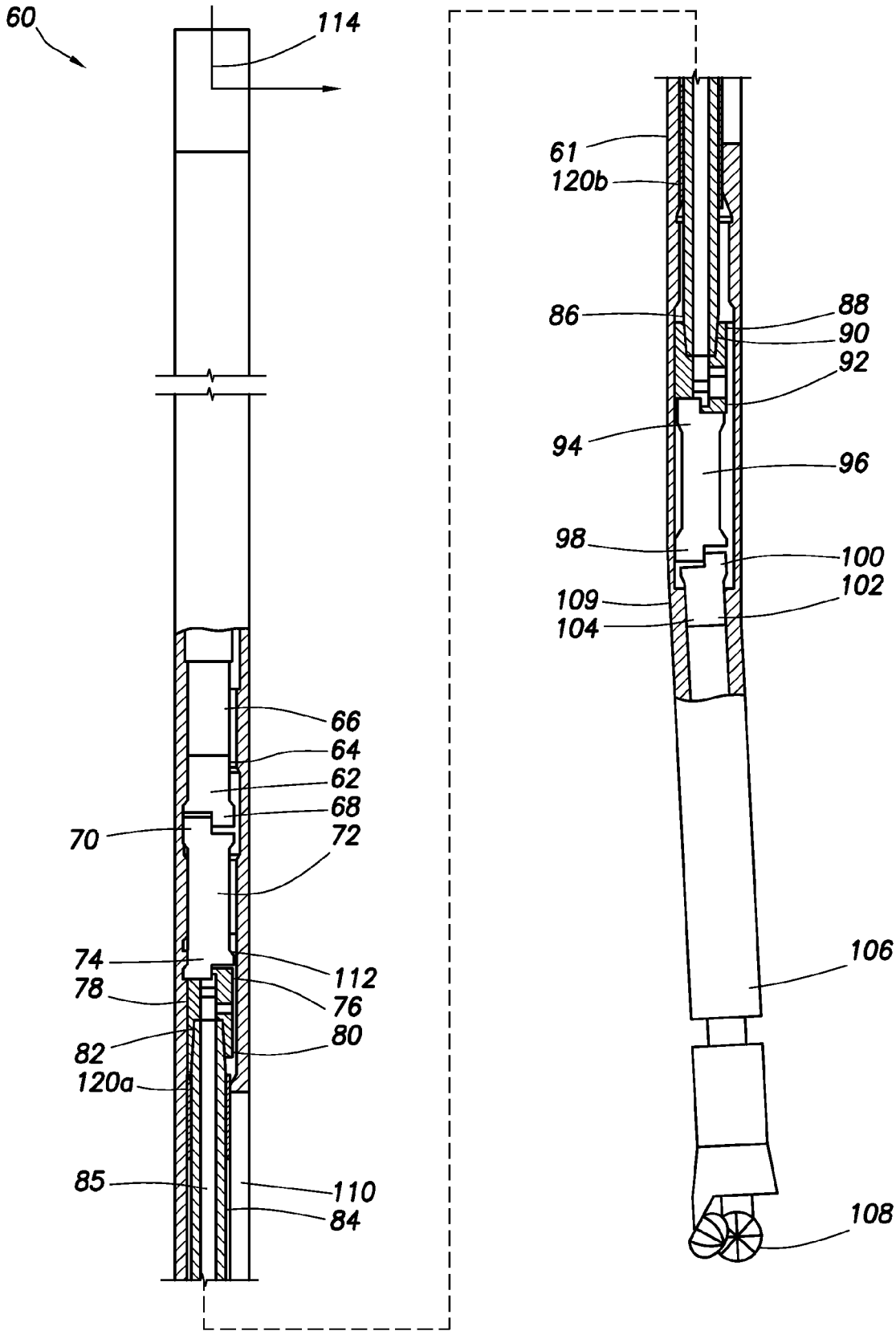
FIG. 4 is a partial cross-sectional view of the apparatus of FIG. 3A taken along section lines 4-4.

Turning now to FIGS. 4 and 5, bore 112 of the housing 61 is an eccentric bore that is offset from housing axis 114 of the housing 61. A suitable offset from housing axis 114 may be selected for any given design of the downhole tool 60. For example, in one embodiment, the offset is approximately 0.35 inches. Other offset distances may be selected without departing from the spirit of the present disclosure. The offset configuration allows bore 112 to accommodate a sensor and data transmission assembly 116 on the housing 61. One of ordinary skill in the art will appreciate that the bore offset may be varied to suit design requirements.

Figure 4A:
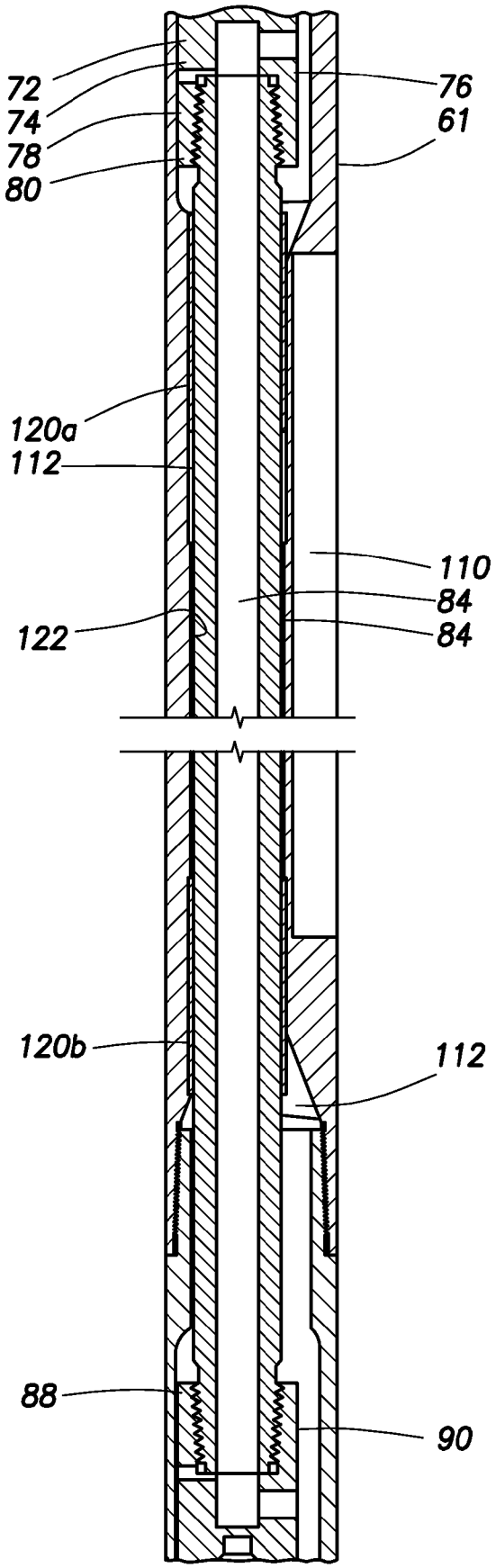
FIG. 4A is an exploded view of portions of the cross-sectional view of FIG. 4.

With continuing reference to FIGS. 4, 4A, and 5, first and second radial bearings 120*a*, 120*b* are disposed in the housing 61 to support connecting shaft 84. The first and second radial bearings 120*a*, 120*b* prevent connecting shaft 84 from rubbing against inner surface 122 of housing 61 thereby. This arrangement of connecting shaft 84 and bearings 120*a*, 120*b* protects inner surface 122 of housing 61 from wear and tear and elongates the service life of the downhole tool 60.

Figure 3A:
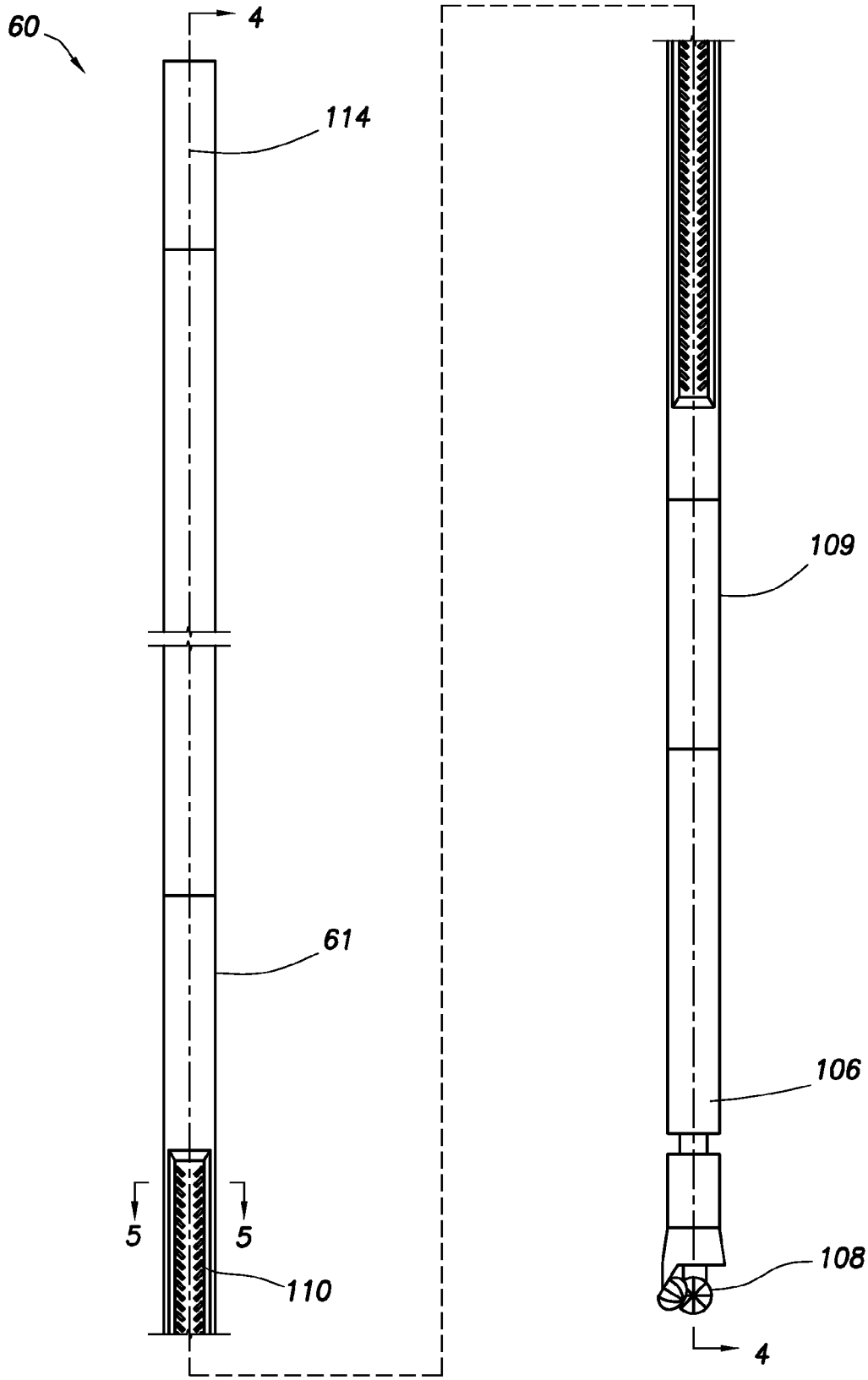
FIG. 3A is a front elevational view of another embodiment of the apparatus of FIG. 1.

One of ordinary skill in the art with the benefit of the present disclosure will appreciate the advantages that are derived from using the multi-shaft configuration of FIG. 3A. The use of connecting shaft 84 together with multiple couplings/shafts negates the need for the flexibility of flexible shaft 6 disclosed in FIG. 1B. Therefore, connecting shaft 84 is capable of delivering more power to drill bit 108 than flexible shaft 6 because connecting shaft 84 can be machined to have a diameter that is much larger than the diameter of flexible shaft 6. This increased power facilitates the use of rotor 4 that is capable of generating higher torques.

Figure 3B:
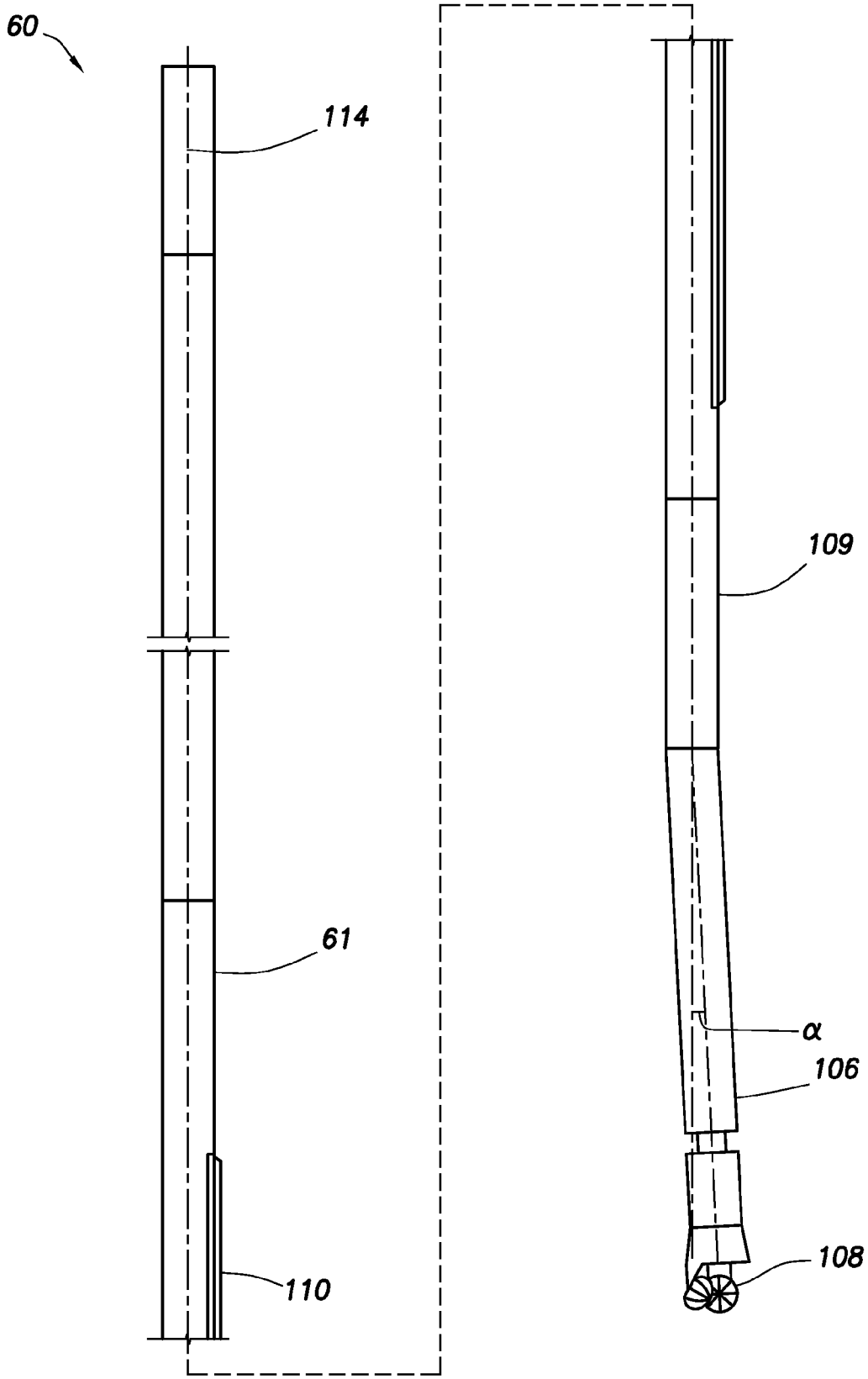
FIG. 3B is a side elevational view of the apparatus of FIG. 3A.

As shown in FIG. 3B a bent housing 109 defining a bend angle α is disposed between housing 61 and drill bit 108 to enable an operator change the trajectory of drill bit 108 where directional drilling is desired. Notwithstanding the replacement of flexible shaft 6, the embodiment of FIG. 3A. is capable of achieving directional drilling because each coupling between connecting shaft 84, drive couplings 62, 78, 90, 102, and driven rods 72, 96 are capable of about a 6 degree bend as will be evident to one of ordinary skill in the art. Connecting shaft 84 is also able to accommodate the eccentric motion of the rotor because of the flexibility in the couplings.

I claim:

1. A downhole drilling apparatus for measure while drilling comprising:

a housing defining a longitudinal housing axis, wherein the housing has an upper end and a lower end;

a motor including a rotor, wherein the rotor is adapted to be driven by drilling fluids;

a first drive coupling coupled between the rotor and a first driven rod;

a second drive coupling coupled between the driven rod an a connecting shaft;

a third drive coupling coupled between the connecting shaft and a second driven rod;

a fourth drive coupling coupled between the second driven rod and a motor bearing section;

wherein the connecting shaft extends through an offset bore in the housing and transmits power through the offset bore to the drill bit.

2. The downhole drilling apparatus of claim 1, further including first and second bearings adapted to prevent the connecting shaft from rubbing against an internal surface of the housing.

3. The downhole drilling apparatus of claim 1, further including a recess disposed on the housing.

4. The downhole drilling apparatus of claim 3, wherein a sensor and data transmission assembly is disposed within the recess.

5. The downhole drilling apparatus of claim 4, wherein the sensor and data transmission assembly is capable of short range data communication in a borehole.

6. The downhole drilling apparatus of claim 3, wherein the sensor and data transmission assembly includes sensors.

7. The downhole drilling apparatus of claim 6, wherein the sensor and data transmission assembly includes directional, inclination, formation evaluation, resistivity, or gamma ray sensors.

8. A downhole drilling apparatus for measure while drilling comprising:

a housing defining a longitudinal housing axis having a recess disposed therein to accommodate a sensor and data transmission assembly;

a motor including a rotor, wherein the rotor is actuated by drilling fluids;

a first drive coupling coupled between the rotor and a first driven rod;

a second drive coupling coupled between the driven rod an a connecting shaft;

a third drive coupling coupled between the connecting shaft and a second driven rod;

a fourth drive coupling coupled between the second driven rod and a motor bearing section;

wherein the connecting shaft extends through a bore in the housing and transmits power from the motor to the drill bit.

9. The downhole apparatus of claim 8, further including first and second bearings adapted to prevent the connecting shaft from rubbing against an internal surface of the housing.

10. The downhole apparatus of claim 8, further including directional, inclination, formation evaluation, resistivity, or gamma ray sensors.

11. The downhole apparatus of claim 8, wherein the bore in the housing is offset from a housing axis.

12. A method of drilling with a downhole drilling apparatus comprising:

providing a housing that defines a longitudinal housing axis, wherein the housing has an upper end and a lower end;

providing a motor including a rotor, wherein the rotor is adapted to be driven by drilling fluids;

providing a first drive coupling coupled between the rotor and a first driven rod;

providing a second drive coupling coupled between the driven rod an a connecting shaft;

providing a third drive coupling coupled between the connecting shaft and a second driven rod;

providing a fourth drive coupling coupled between the second driven rod and a motor bearing section;

wherein the connecting shaft extends through an offset bore in the housing and transmits an eccentric motion of the motor to the drill bit.

13. The method of claim 12, further including a step of providing first and second bearings adapted to prevent the connecting shaft from rubbing against an internal surface of the housing.

14. The method of claim 12, further including a step of providing a recess disposed on the housing.

15. The method of claim 14, further including a step of providing a sensor and data transmission assembly disposed within the recess.

16. The method of claim 15, wherein the sensor and data transmission assembly is capable of short range data communication in a borehole.

* * * * *